US007007430B2

(12) United States Patent
Gustafsson

(10) Patent No.: US 7,007,430 B2
(45) Date of Patent: Mar. 7, 2006

(54) METHOD FOR IMPEDING TRANSVERSE RELATIVE DISPLACEMENTS OF A PIPE AND AT LEAST ONE CABLE

(75) Inventor: Pelle Gustafsson, Hong Kong (HK)

(73) Assignee: VSL International AG, Bern (CH)

( * ) Notice: Subject to any disclaimer, the term of this patent is extended or adjusted under 35 U.S.C. 154(b) by 0 days.

(21) Appl. No.: 10/407,409

(22) Filed: Apr. 4, 2003

(65) Prior Publication Data

US 2003/0196827 A1 Oct. 23, 2003

(30) Foreign Application Priority Data

Apr. 22, 2002 (EP) ..... 02405328

(51) Int. Cl.
*E04C 5/08* (2006.01)

(52) U.S. Cl. ..... 52/223.4; 52/223.8; 52/742.13; 52/742.16

(58) Field of Classification Search ..... 52/223.1, 52/223.4, 223.8, 223.14, 146, 148, 167.1, 52/724.2, 600, 260, 742.16, 699, 742.13
See application file for complete search history.

(56) References Cited

U.S. PATENT DOCUMENTS 3,917,285 A * 11/1975 Swanson et al. ..... 277/314
3,935,685 A * 2/1976 Howlett ..... 52/223.13
4,372,706 A * 2/1983 Young ..... 405/195.1
4,612,680 A 9/1986 Daiguji
5,079,879 A * 1/1992 Rodriguez ..... 52/223.13
5,479,671 A * 1/1996 Stubler et al. ..... 14/22
5,624,628 A 4/1997 Hansch
5,803,641 A 9/1998 Nuetzel
5,809,711 A * 9/1998 Werner ..... 52/223.2
6,138,309 A * 10/2000 Tadros et al. ..... 14/25
6,327,825 B1 * 12/2001 Sanders et al. ..... 52/167.1

FOREIGN PATENT DOCUMENTS

EP 0 169 276 A1 1/1986

* cited by examiner

*Primary Examiner*—Carl D. Friedman
*Assistant Examiner*—Chi Q. Nguyen
(74) *Attorney, Agent, or Firm*—Hahn Loeser & Parks LLP

(57) ABSTRACT

A method impedes transverse relative displacements of a pipe (2) and at least one cable (3) which extends in this pipe (2), and doing so with a certain transverse play (4). The method has the steps of: selecting at least one portion (8), of a predetermined longitudinal dimension (L8), of pipe (2), and, then, with the cable (3) inserted in the pipe (2), locally constructing between the cable (3) and said pipe (2) at least one wedging element (9) adapted to suppress the transverse play (4) existing between the cable (3) and the pipe (2) in said at least one selected pipe portion (8).

14 Claims, 5 Drawing Sheets

METHOD FOR IMPEDING TRANSVERSE RELATIVE DISPLACEMENTS OF A PIPE AND AT LEAST ONE CABLE

This application claims priority to European Patent Application EP 02 405 328.2 filed on Apr. 22, 2002.

The invention relates to a method for impeding transverse relative displacements of a pipe and at least one cable which extends into this pipe, and this with a certain transverse play. The invention also relates to assemblies each made up of a cable and a pipe which are immobilized with respect to one another according to the aforementioned method. The invention also relates to stayed structures which include at least one assembly of the aforementioned type.

BACKGROUND OF THE ART

Designated by cable is particularly, but not exclusively, a cable used for the construction of stayed structures, such as suspension bridges, cable-stayed bridges, stadium roofs, buildings, telecommunications towers, etc.

Such a cable comprises at least one strand embedded in a protective piping, but, generally, such a cable is constituted of a bundle of strands.

For example, each strand is made up of a plurality of monostrands which are themselves made up of metallic wires.

Each strand can either be made up of a bare metallic strand or an individually greased and sheathed monostrand.

Designated by pipe is particularly a robust outer stay pipe which achieves a full encapsulation of the cable in order to ensure durability of said cable.

During construction of a system of stays, a pipe—also referred to as a stay pipe—is generally placed between two points of anchorage provided for the cable—also referred to as a stay cable. Then the cable is constructed in the pipe in particular through successive introduction of cable strands.

This method of construction implies the use of a pipe whose inner diameter is noticeably greater than the outer diameter of the cable.

Thus, when a stay has been constructed, there exists a noticeable play between the pipe and the cable, and this transverse play is sufficient to allow a transverse displacement relative to the two elements (the said pipe and the said cable) under the effect of a moving force applied on the outer surface of the pipe, such as the action of the wind.

When the intensity of the moving force fluctuates (varies), it can bring about a rattling of the cable which causes noise and mechanical actions that can be detrimental for the life of the assembly.

One result which the invention aims to obtain is a method that makes it possible to prevent in a simple and economical way the relative displacement of a pipe, such as a stay pipe, and a cable, such as a stay cable, these elements being assembled, one in the other, with a certain transverse play.

Another result which the invention aims to obtain is a method that can be adapted to different configurations of pipe and cable.

SUMMARY OF THE INVENTION

To achieve these objects, the invention has as its subject matter a method for impeding transverse relative displacements of a pipe and at least one cable which extends into this pipe and this with a certain transverse play, this method being in particular characterized in that:

According to the invention, this method comprises the following steps of: 1) selecting at least one portion of pipe of a predetermined longitudinal dimension; and 2) then, with the cable inserted in the pipe, locally constructing between the cable and said pipe at least one wedging element of a nature so as to suppress the transverse play existing between the cable and the pipe in said at least one selected pipe portion.

The invention also relates to assemblies each made up of a cable and a pipe which are treated according to the method of the invention, i.e., immobilized with respect to one another according to the aforementioned method, and to structures which include at least one assembly of the aforementioned type.

BRIEF DESCRIPTION OF THE DRAWINGS

The invention will be better understood from reading the following description, given by way of non-limiting example, with reference to the attached drawings.

DETAILED DESCRIPTION OF A PREFERRED EMBODIMENT

Figure 1:
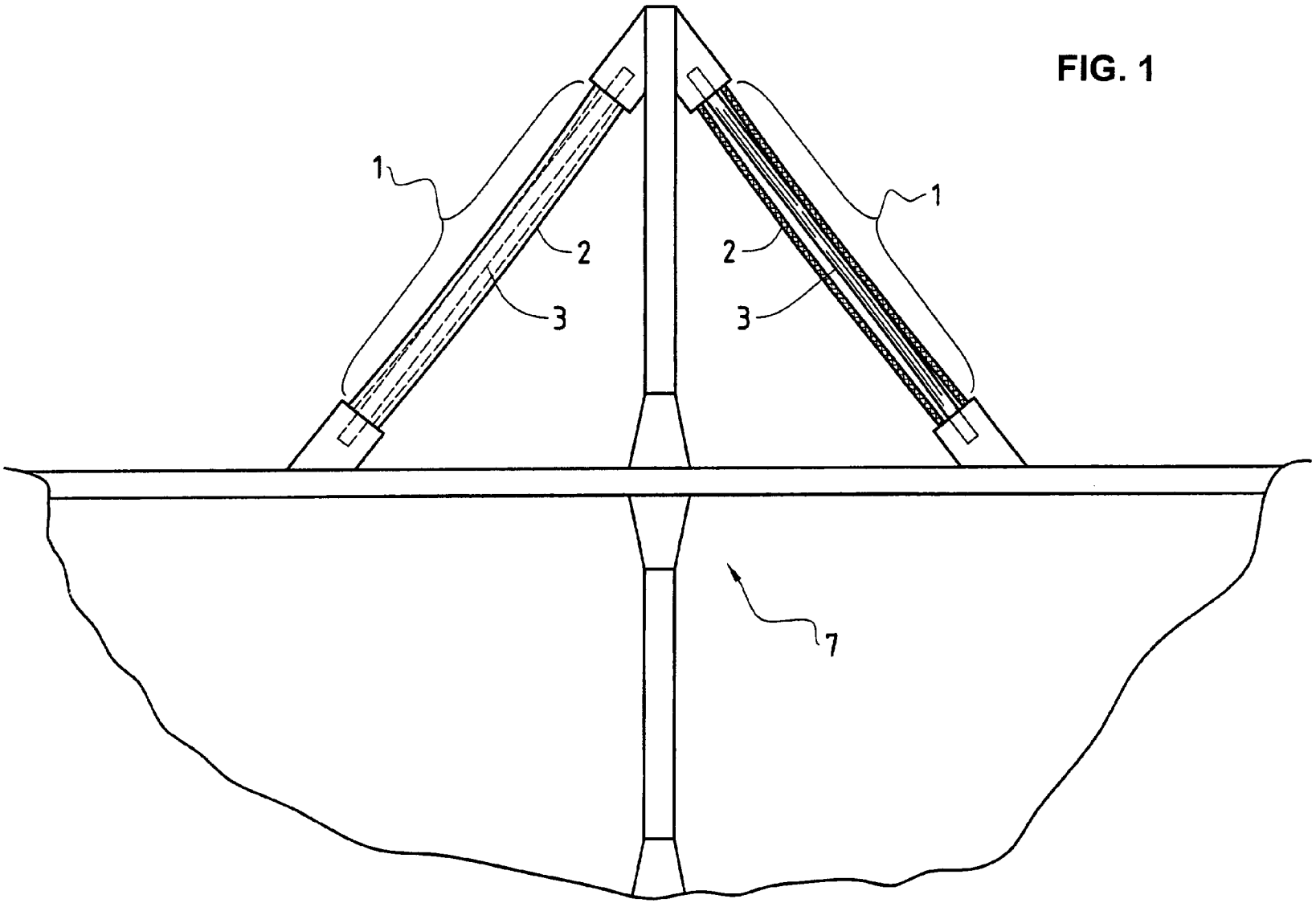
FIG. 1 is a lateral view of a structure having two assemblies each made up of a cable and a pipe.

Referring to the drawings, one sees an assembly 1 including at least one pipe 2 and one cable 3 engaged in this pipe 2 with a transverse play sufficient 10 allow a transverse displacement relative to the two elements, i.e. the said pipe 2 and the said cable 3, for example under the effect of a moving force 5 applied on the outer surface 6 of the pipe 2.

Figures 2, 3, 4:
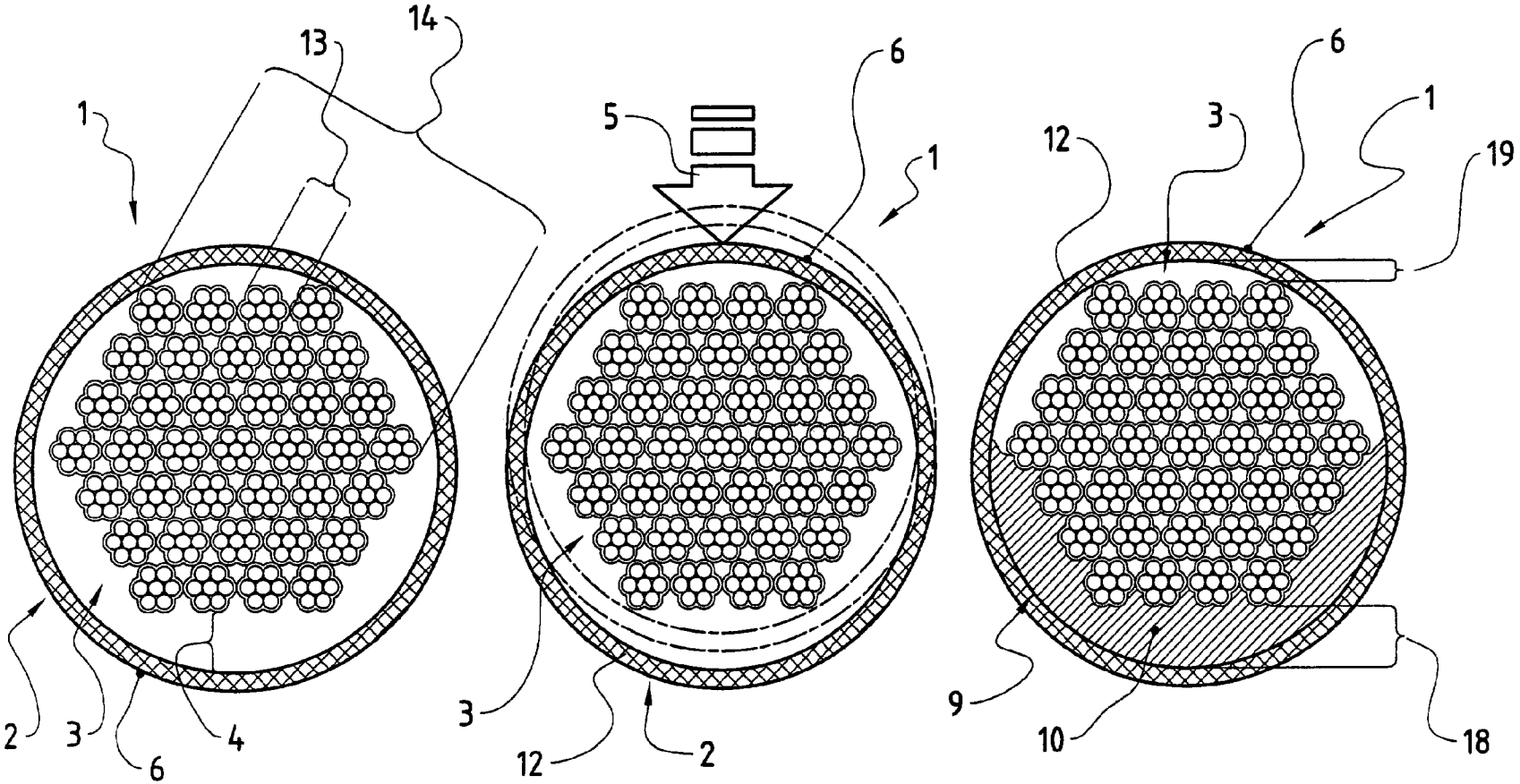
FIG. 2 is a cross-sectional view along 2—2, on a larger scale, of a cable and a pipe making up one of the assemblies of FIG. 1.
FIG. 3 is a cross-sectional view of a cable and a pipe subjected to the action of the wind.
FIG. 4 is a cross-sectional view of a cable and a pipe immobilized with respect to one another according to the method of the invention.
Figure 5:
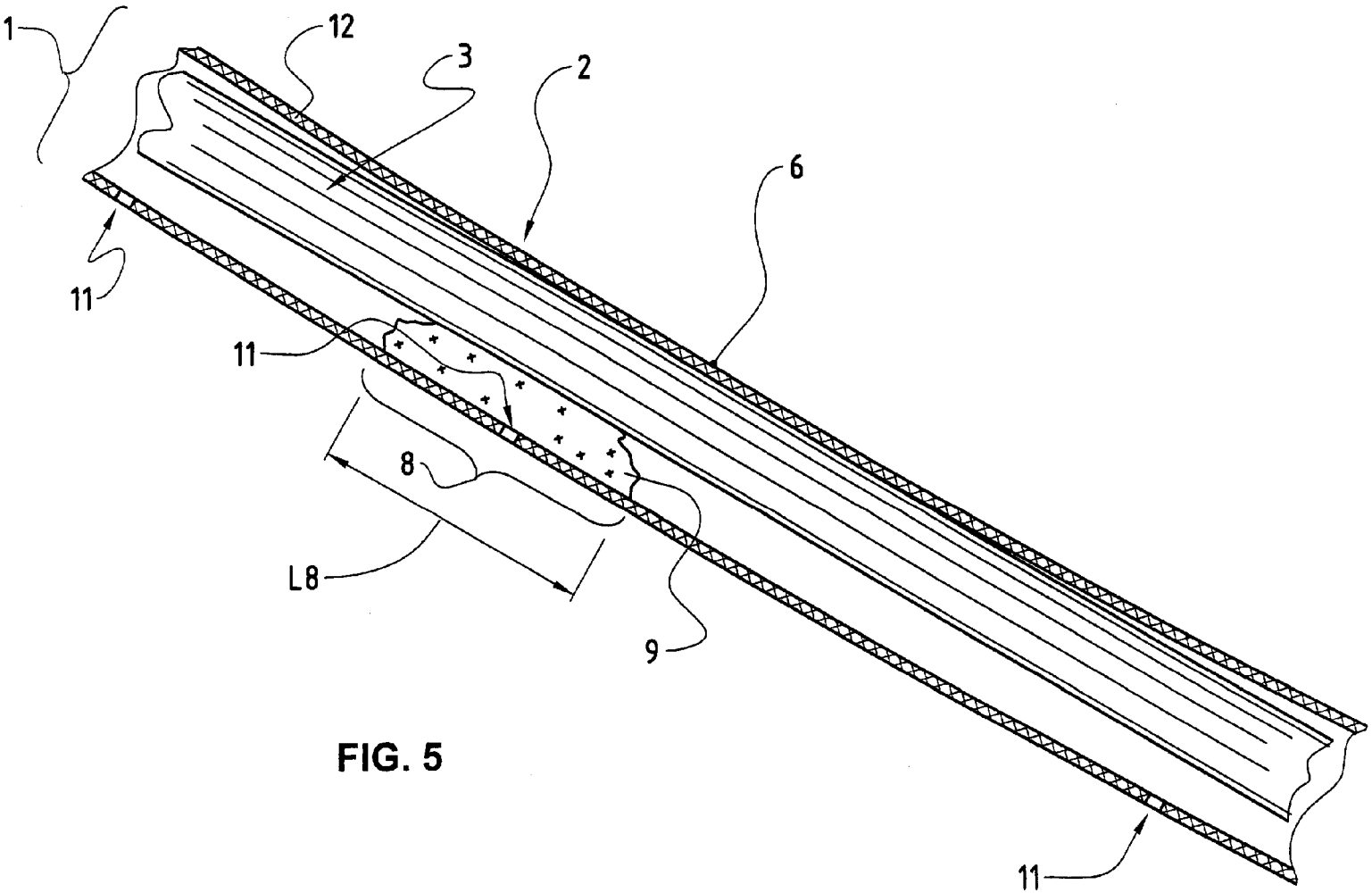
FIGS. 5 and 6 are two partial views and a longitudinal section of a pipe and a cable during the immobilization according to two variants of the method of the invention.
Figure 6:
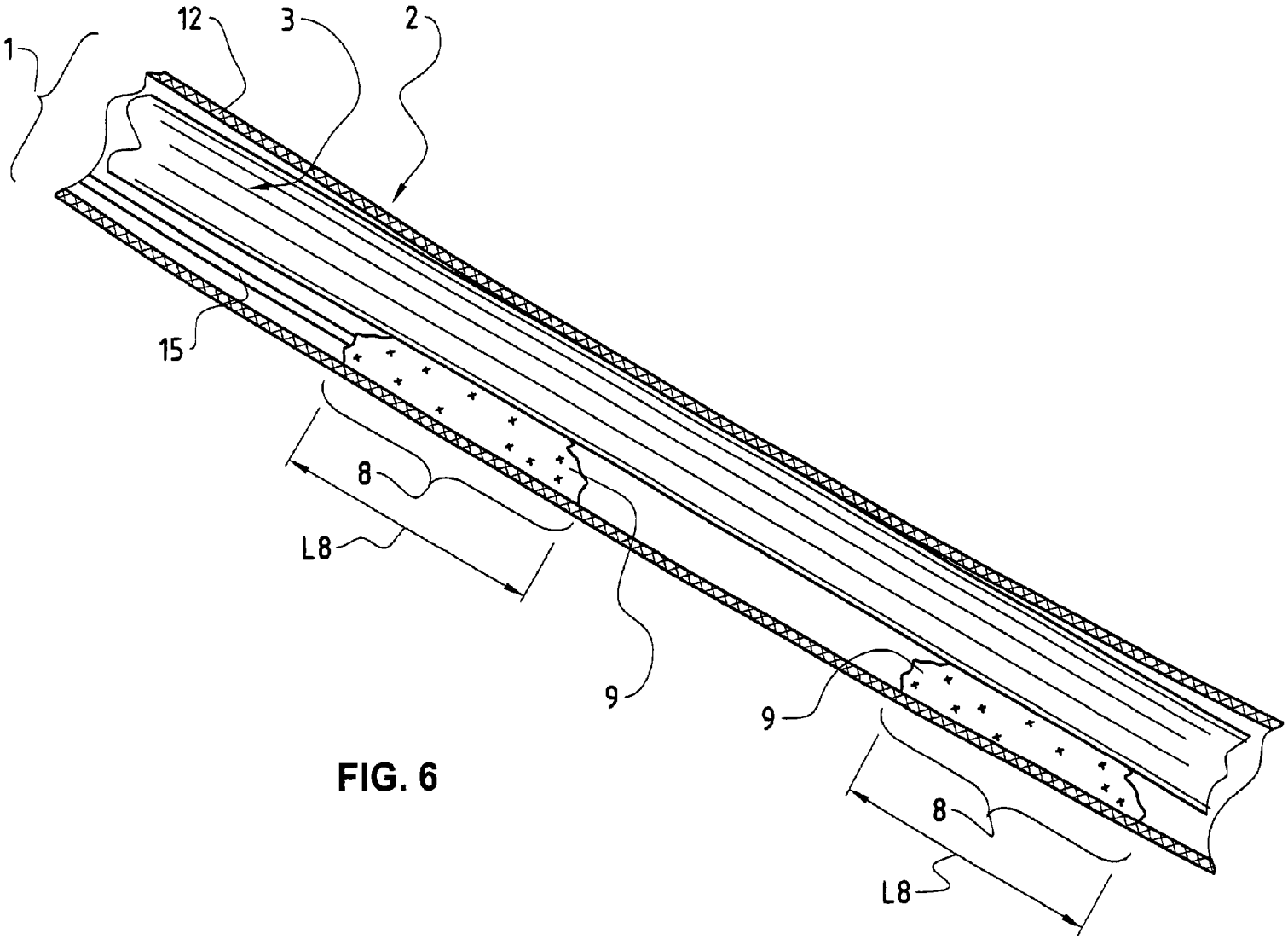

In FIG. 3, the moving force 5 has been indicated by a large broken arrow and the displacement of the pipe 2 which results has been indicated by fine lines of dots and dashes.

The pipe 2 and the cable 3 each have a predetermined longitudinal dimension L2, L3 and the cable 3 is engaged in the pipe 2, at least partially, but generally over the entire longitudinal dimension L2 of this pipe 2.

A transverse displacement relative to the pipe 2 and the cable 3 can be expected when the flexibility of the cable 3 and/or of the pipe 2 is sufficient to allow such a displacement as is frequent in the case of stayed structures 7 such as bridges 7.

In FIG. 1, such a structure 7 has been shown with noticeable simplifications and with details greatly enlarged over reality in order to facilitate better understanding of the invention.

The cable 3 has each of its ends 30, 31 firmly anchored to an anchoring device 70, 71 itself connected to the structure 7.

Likewise, the pipe 2 also has each of its ends 20, 21 firmly anchored to the device 70, 71 for anchoring the ends of the cable 3.

The technical particularities of the anchoring devices 70, 71 are not shown in further detail or have not been represented because they are not directly related to the invention.

As has been indicated further above, particularly when the intensity of the moving force 5 fluctuates (varies), this moving force 5 can bring about a rattling of the pipe 2 on the cable 3 which causes noise and mechanical actions that can be detrimental for the life of the assembly of pipe 2 and cable 3.

Although not exclusive to stayed structures 7, such as bridges 7, these rattling phenomena are typical for such stayed structures 7.

This is why the term cable 3 particularly—but not exclusively—designates a cable 3 used for the construction of stayed structures 7, such as suspension bridges, cable-stayed bridges, stadium roofs, buildings, telecommunications towers, etc.

As shown, the pipe 2 is a pipe intended to protect a cable 3 consisting of a stay cable, such as a stay cable of a suspended bridge 7, and in this case the mentioned moving force 5 results in particular from the action of the wind.

The invention relates to a method for impeding transverse relative displacements of a pipe 2 and at least one cable 3 which extends in this pipe 2, and doing so with a certain transverse play.

According to the invention, this method comprises the following steps: selecting at least one portion 8, of a predetermined longitudinal dimension L8, of pipe 2, then, with the cable 3 inserted in the pipe 2, locally constructing between the cable 3 and said pipe 2 at least one wedging element 9 of a nature so as to suppress the transverse play 4 existing between the cable 3 and the pipe 2 in said at least one selected pipe portion 8.

According to the method of the invention, the said wedging element 9 is constructed by injecting locally into the pipe 2 a substance 10 in a flowable first state, the substance then solidifying into a non-flowable second state. This solidification can occur through a variety of processes.

In a noteworthy way, polyurethane foam is used in making each wedging element 9.

According to a first embodiment of the method of the invention, in injecting said substance 10 locally into the pipe 2, at least one orifice 11 is traversed that has been provided beforehand in the pipe wall 12 at a predetermined place on the selected pipe portion 8.

One skilled in the art will know how to determine the position and the length L8 of each portion of pipe 2 in which a wedging element 9 must be formed.

When the injection of the substance 10 into the pipe 2 must be carried out through an orifice 11 made beforehand in a portion 8, selected beforehand, of the wall of this pipe 2, one skilled in the art will know how to choose the means best suited for an operation of piercing an orifice 11 in the wall 12 of the pipe for an operation of injection of the substance 10 into this pipe 2.

The piercing means has not been shown.

Figure 7:
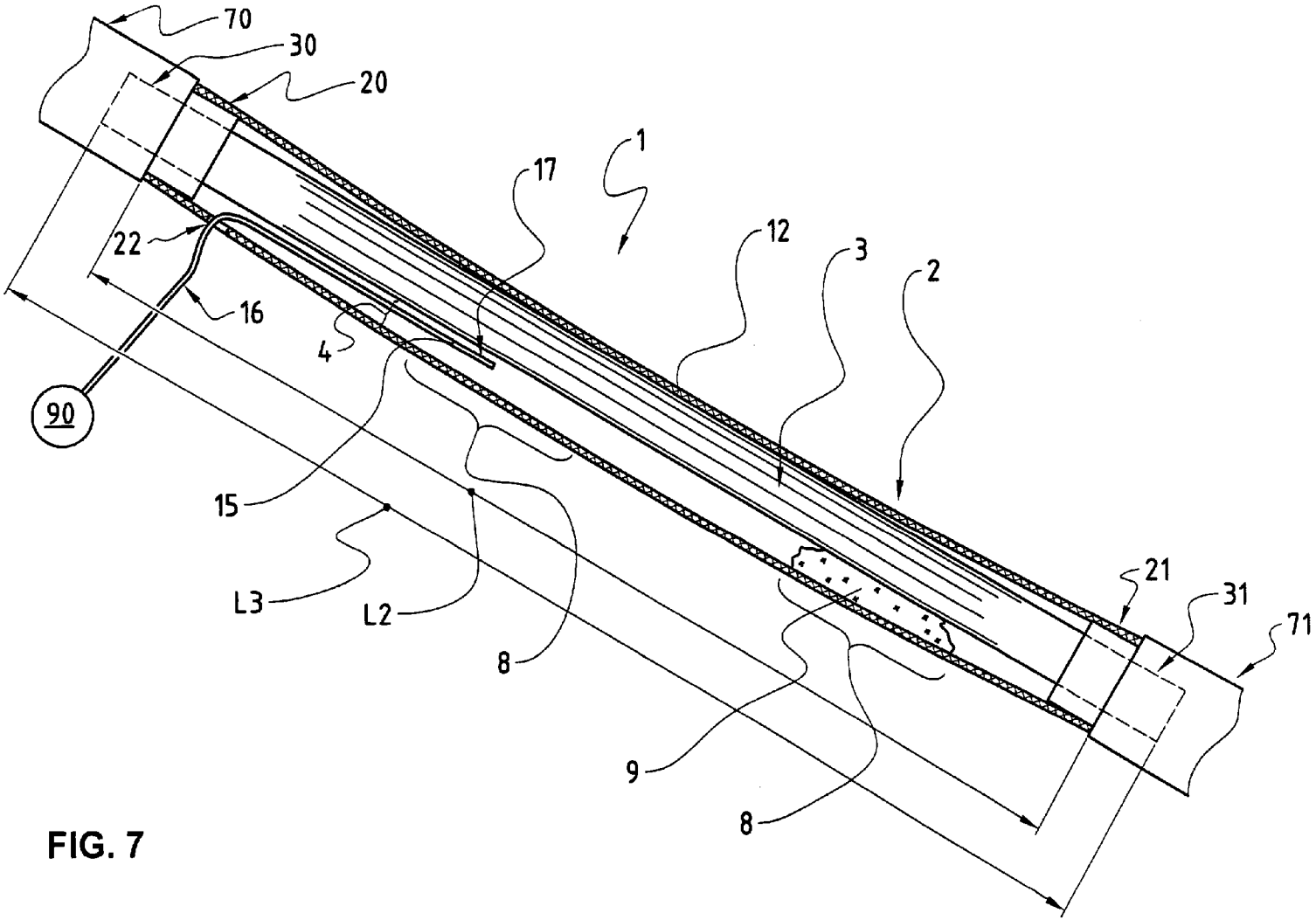
FIG. 7 is a diagrammatic longitudinal section of a pipe and a cable during immobilization according to the method of the invention.

The injection means has been symbolized simply by the encircled 90 marking in FIG. 7.

According to a second embodiment of the method of the invention, 20 the substance 10 is injected locally in said pipe 2 by means of the following steps:

disposing at least one duct 15 in said pipe in such as way that this duct 15 has one end 16, referred to as the near end 16, which is situated outside the pipe 2, and the other end 17, referred to as the remote end 171 which is situated inside said pipe 2, and after having disposed all said strands 13 in the pipe 2, adjusting the position of said remote end 17 of the duct 15 in the pipe 2, through action upon said duct 15 so as to place said remote end 17 in a selected pipe portion 8 to constitute a wedging element 9, injecting said substance 10 into the duct 15 from the near end 16, and doing so in such a way as to make this substance 10 come out again through the remote end 17 situated in the selected pipe portion 8 until the wedging element 9 is formed.

As has been explained, the cable 3 is made up of a plurality of strands 13 which are disposed successively in the pipe 2 so as to constitute a bundle 14 of a predetermined number of strands 13.

This technique of constructing cable 3 in the pipe 2 is not described in further detail because it does not form part of the invention as such.

Moreover, one skilled in the art knows different techniques for constructing a cable 3 in a pipe 2, and the method according to the invention is independent of these techniques.

According to the method of the invention, each duct 15 is disposed in the pipe at least after the cable has been formed in the pipe 2, but preferably before the said cable 3 is formed in the said pipe 2.

According to the method of the invention, when it is necessary to form a plurality of wedging elements 9 in the pipe 2, the method comprises the following steps:

moving the remote end 17 of the duct 15*t* through action on the duct 15, into another selected pipe portion 8 in which a wedging element 9 is to be formed, then forming said wedging element, and continuing this procedure until all wedging elements 9 have been formed.

In a noteworthy way, the position of said remote end 17 of said duct 15 in said pipe 2 is adjusted by acting upon said duct 15 through traction, in particular from its near end 16.

According to the method of the invention, to adjust the position of the remote end 17 in the pipe 2, one proceeds with controlled traction on the said duct 15 by acting upon the near end 16 of this duct 15 which is situated outside the pipe 2, in order to allow this adjustment to be made of the position of the remote end 17 of the duct 15 in the pipe 2 by exerting traction on its near end 16 upon disposing the duct 15 in the pipe, one places this duct 15 in such a way that its remote end 17 can be pulled in any way whatsoever toward a first portion 8 of the duct 2 selected for formation of a wedging element 9.

For example, the near end 16 of the duct 15 passes beyond the pipe at the level of one of its opposite end regions 20, 21 and the adjustment of the position of the remote end 17 in the pipe 2 is carried out by exerting traction on the said duct 15, then on the near end 16.

This near end 16 of the duct 15 can also pass beyond the pipe through a specially made cut-out in the wall 12 of the pipe 2.

In a noteworthy manner, in determining the value for the longitudinal dimension L8 of the selected pipe portion 8 that receives the wedging element 9 intended to be interposed between the cable 3 and said pipe 2, the capability of the substance 10, of which said wedging element 9 is made, to impede the displacement of the pipe 2 and/or the cable 3 is taken into account.

In a manner which is noteworthy, in the selected pipe portion 8, having a transversal lower part 18 and a transversal upper part 19, the wedging element 9 is made in the transversal lower part 18 of the selected pipe portion 8 in such a way as to bring the cable 3 into contact with the pipe 2 in the transversal upper part 19 of the selected pipe portion 8.

In another noteworthy manner, in the selected pipe portion 8, having a transversal lower part 18 and a transversal upper part 19, the wedging element 9 is made in the transversal upper part 19 of the selected pipe portion 8 in such a way as to keep the cable 3 in contact with the pipe 2 in the transversal lower part 18 of the selected pipe portion 8.

As has been specified, the invention also relates to assemblies 1 made up of a pipe 2 and a cable 3 which have been treated according to the method, i.e. are immobilized with respect to one another according to the method described above.

An assembly 1 made up of a pipe 2 and cable treated according to the method of the invention is noteworthy in that it comprises at least one portion 8, of predetermined longitudinal dimension L8, of pipe 2, in which portion at least one wedging element 9 is located constructed locally between the cable 3 and said pipe 2, this at least one wedging element 9 being of a nature so as to suppress the transverse play 4 existing between the cable 3 and the pipe 2 in said at least one selected pipe portion 8.

Likewise, an assembly 1 made up of a pipe 2 and a cable 3 treated according to the method of the invention is noteworthy in that at least one wedging element 9 is located disposed between the cable 3 and said pipe 2 in at least one portion 8, of predetermined longitudinal dimension L8, of pipe 2, said wedging element 9 being constructed by injecting locally into the pipe 2 a substance 10 able to solidify.

As has been specified, the invention also relates to structures 7 comprising at least one assembly 1 made up of a pipe 2 and a cable 3 of the aforementioned type.

What is claimed is:

1. A method for impeding transverse relative displacements of a pipe and at least one cable that extends in this pipe with a certain transverse play, the method comprising the steps of:

selecting at least one portion of the pipe, said at least one portion having a predetermined longitudinal dimension;

constructing at least one wedging element locally between the pipe and the cable inserted therein, said at least one wedging element adapted to suppress said transverse play in said at least one selected pipe portion;

wherein the step of constructing said at least one wedging element is achieved by injecting a substance locally into the pipe in a flowable first state, the substance then solidifying into a non-flowable second state, said injecting comprising the steps of:

disposing at least one duct in the pipe so that the duct has a near end situated outside the pipe and a remote end situated inside the pipe;

disposing the cable in the pipe by inserting a plurality of strands in the pipe to define a bundle having a predetermined number of the strands, which bundle comprises the cable;

after disposing the plurality of strands in the pipe, adjusting the position of the remote end of the duct in the pipe, such that the remote end of the duct is in a selected portion of the pipe to constitute the wedging element; and injecting said substance into the duct from the near end thereof, such that the substance comes out of the duct at the remote end until the wedging element is formed.

2. The method of claim 1, wherein the step of injecting said substance locally in said pipe further comprises:

repeating the steps of adjusting the position of the remote end of the duct and injecting the substance into the duct until the wedging element is formed, thereby forming a plurality of the wedging elements in the pipe, each said wedging element located at one of a plurality of selected portions of the pipe.

3. The method of claim 2, wherein the step of adjusting the position of the remote end of the pipe comprises the step of acting on the duct by traction.

4. The method of claim 3, wherein the step of acting on the duct by traction is accomplished by applying controlled traction on the duct by acting upon the near end thereof, and wherein the duct is placed in the pipe so that the remote end is positioned to be pulled toward a first portion of the pipe selected for formation of the wedging element.

5. The method of claim 4, wherein the step of determining the predetermined longitudinal dimension of the selected pipe portion is accomplished by taking into account the capability of the wedging element to be constructed to impede the displacement of the pipe.

6. The method of claim 1, wherein the step of determining the predetermined longitudinal dimension of the selected pipe portion is accomplished by taking into account the capability of the wedging element to be constructed to impede the displacement of the pipe.

7. The method of claim 5, wherein the step of constructing the at least one wedging element further comprises:

forming the at least one wedging element in a transverse lower portion of the selected pipe portion so as to bring the cable into contact with a transverse upper part of the selected pipe portion.

8. The method of claim 6, wherein the step of constructing the at least one wedging element further comprises:

forming the at least one wedging element in a transverse lower portion of the selected pipe portion so as to bring the cable into contact with a transverse upper part of the selected pipe portion.

9. The method of claim 5, wherein the step of constructing the at least one wedging element further comprises:

forming the at least one wedging element in a transverse upper portion of the selected pipe portion so as to retain the cable into contact with a transverse lower part of the selected pipe portion.

10. The method of claim 6, wherein the step of constructing the at least one wedging element further comprises:

forming the at least one wedging element in a transverse upper portion of the selected pipe portion so as to retain the cable into contact with a transverse lower part of the selected pipe portion.

11. The method of claim 1, wherein each at least one wedging element comprises polyurethane foam.

12. The method of claim 1, wherein the injected substance comprises polyurethane foam.

13. The method of claim 7, wherein the injected substance comprises polyurethane foam.

14. The method of claim 9, wherein the injected substance comprises polyurethane foam.

* * * * *